US008583020B2

(12) United States Patent
Yoshikawa et al.

(10) Patent No.: US 8,583,020 B2
(45) Date of Patent: Nov. 12, 2013

(54) FIXING DEVICE AND IMAGE FORMING APPARATUS INCORPORATING SAME

(75) Inventors: Masaaki Yoshikawa, Tokyo (JP); Yoshiki Yamaguchi, Kanagawa (JP); Toshihiko Shimokawa, Kanagawa (JP); Kenji Ishii, Kanagawa (JP); Naoki Iwaya, Tokyo (JP); Takahiro Imada, Kanagawa (JP); Yutaka Ikebuchi, Kanagawa (JP); Tetsuo Tokuda, Kanagawa (JP); Takamasa Hase, Kanagawa (JP); Hiroshi Yoshinaga, Chiba (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 293 days.

(21) Appl. No.: 13/045,182

(22) Filed: Mar. 10, 2011

(65) Prior Publication Data

US 2011/0229228 A1 Sep. 22, 2011

(30) Foreign Application Priority Data

Mar. 18, 2010 (JP) ..... 2010-061892

(51) Int. Cl.
*G03G 15/20* (2006.01)

(52) U.S. Cl.
USPC ..... 399/329

(58) Field of Classification Search
USPC ..... 399/122, 320, 328, 330, 331, 333, 335, 399/336, 338; 219/216
See application file for complete search history.

(56) References Cited

U.S. PATENT DOCUMENTS

| | | | | |
|---|---|---|---|---|
| 6,021,303 | A | 2/2000 | Terada et al. | |
| 6,748,192 | B2 * | 6/2004 | Izawa et al. | 399/329 |
| 8,064,798 | B2 * | 11/2011 | Shinshi et al. | 399/122 |
| 2003/0183610 | A1 | 10/2003 | Okabayashi et al. | |

(Continued)

FOREIGN PATENT DOCUMENTS

| | | | |
|---|---|---|---|
| EP | 0 957 412 | A2 | 11/1999 |
| EP | 0 957 412 | A3 | 11/1999 |

(Continued)

OTHER PUBLICATIONS

Extended Search Report issued Apr. 3, 2012 in Europe Application No. 11157851.4.

(Continued)

*Primary Examiner* — David Gray
*Assistant Examiner* — Michael Harrison
(74) *Attorney, Agent, or Firm* — Oblon, Spivak, McClelland, Maier & Neustadt, L.L.P.

(57) ABSTRACT

A fixing device includes a tubular belt holder, a rotatable flexible fuser belt, a contact member, a pressure member, and a heater. The tubular belt holder extends in an axial direction thereof. The fuser belt is looped into a generally cylindrical configuration around the belt holder. The tubular belt holder retains the fuser belt in shape as the belt rotates in a circumferential direction. The contact member and pressure member extend in the axial direction. The pressure member presses against the contact member through the fuser belt to form a fixing nip. The heater is disposed to heat a predetermined circumferential portion of the fuser belt. The belt holder includes a first circumferential section and a second circumferential section. The first circumferential section faces the heated portion. The second circumferential section faces upstream from the heated portion in the circumferential direction.

10 Claims, 9 Drawing Sheets

(56) References Cited

U.S. PATENT DOCUMENTS

| | | | |
|---|---|---|---|
| 2008/0298862 | A1 | 12/2008 | Shinshi |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0116848 | A1 | 5/2011 | Yamaguchi et al. |
| 2011/0129268 | A1 | 6/2011 | Ishii et al. |

FOREIGN PATENT DOCUMENTS

| | | |
|---|---|---|
| JP | 8-179641 A | 7/1996 |
| JP | 10-213984 | 8/1998 |
| JP | 2884714 | 2/1999 |
| JP | 3298354 | 4/2002 |
| JP | 2003-84591 | 3/2003 |
| JP | 3592485 | 9/2004 |
| JP | 2007-334205 | 12/2007 |
| JP | 2008-158482 | 7/2008 |
| JP | 2008-216928 | 9/2008 |
| JP | 2009-3410 | 1/2009 |
| JP | 2009-104019 | 5/2009 |
| JP | 2009-217161 | 9/2009 |

OTHER PUBLICATIONS

U.S. Appl. No. 13/026,945, filed Feb. 14, 2011, Ishii, et al.

U.S. Appl. No. 13/044,970, filed Mar. 10, 2011, Yoshikawa, et al.

Office Action issued on Feb. 28, 2013, in Chinese patent Application No. 201110059908.6.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2010-061892, filed on Mar. 18, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a multi-roller, belt-based fuser assembly that employs an endless, flexible fuser belt entrained around multiple rollers, paired with a pressure roller pressed against the outer surface of the fuser belt to form a fixing nip therebetween. The fuser belt is held on a heat roller equipped with an internal heater, which heats the length of the fuser belt through contact with the heat roller. At the fixing nip, a toner image on an incoming recording sheet is fixed in place with heat from the fuser belt and pressure from the pressure roller.

Another type of fixing device includes a film-based fuser assembly that employs a fuser belt formed of thin heat-resistant film cylindrically looped around a stationary, ceramic heater, which is paired with a pressure roller that rotates while pressing against the stationary heater through the fuser belt to form a fixing nip therebetween. At the fixing nip, the pressure roller rotates to advance the fuser belt together with an incoming recording sheet, while the stationary heater heats the recording sheet via the fuser belt, so that a toner image is fixed in place with heat from the stationary heater and pressure from the pressure roller.

Of the two types of fuser assembly described above, the film-based assembly is superior to its counterpart in terms of processing speed and thermal efficiency. Owing to the heat-resistant film which exhibits a relatively low heat capacity and therefore can be swiftly heated, the film-based fuser assembly eliminates the need for keeping the heater in a sufficiently heated state when idle, resulting in a shorter warm-up time and smaller amounts of energy wasted during standby, as well as a relatively compact size of the fuser assembly.

By contrast, the multi-roller belt fuser, although advantaged over a conventional roller-based fuser, involves a substantial warm-up time to heat the fixing nip to a temperature sufficient for fusing toner and first-print time to complete an initial print job upon activation, limiting its application to relatively slow imaging systems.

Overcoming the limitation of the belt-based fixing device, the film-based fixing device finds applications in high-speed, on-demand compact printers that can promptly execute a print job upon startup with significantly low energy consumption.

Although generally successful for its intended purpose, the fixing device using a thin film fuser also has drawbacks. One drawback is its vulnerability to wear, where the heat-resistant film has its inner surface repeatedly brought into frictional contact with the surface of the stationary ceramic heater. The frictionally contacting surfaces of the film and the heater readily chafe and abrade each other, which, after a long period of operation, results in increased frictional resistance at the heater/film interface, leading to disturbed rotation of the fuser belt, or increased torque required to drive the pressure roller. If not corrected, such defects can eventually cause failures, such as displacement of a printed image caused by a recording sheet slipping through the fixing nip, and damage to a gear train driving the fixing members due to increased stress during rotation.

Another drawback is the difficulty in maintaining a uniform processing temperature throughout the fixing nip. The problem arises where the fuser film, which is once locally heated at the fixing nip by the heater, gradually loses heat as it travels downstream from the fixing nip, so as to cause a discrepancy in temperature between immediately downstream from the fixing nip (where the fuser belt is hottest) and immediately upstream from the fixing nip (where the fuser belt is coldest). Such thermal instability adversely affects fusing performance of the fixing device, particularly in high-speed applications where the rotational fixing member tends to dissipate higher amounts of heat during rotation at a high processing speed.

The former drawback of the fixing device has been addressed by another conventional fixing device, which uses a lubricant, such as a low-friction sheet of fiberglass impregnated with polytetrafluoroethylene (PTFE), disposed between the contacting surfaces of a stationary pressure pad and a rotatable fixing belt. In this fixing device, the rotatable fixing belt is looped for rotation around the stationary pressure pad, while held in contact with an internally heated, rotatable fuser roller that has an elastically deformable outer surface. The pressure pad is spring-loaded to press against the fuser roller through the fixing belt, which establishes a relatively large fixing nip therebetween as the fuser roller elastically deforms under pressure.

According to this arrangement, provision of the lubricant sheet prevents abrasion and chafing at the interface of the stationary and rotatable fixing members, as well as concomitant defects and failures of the fixing device. Moreover, the relatively large fixing nip translates into increased efficiency in heating a recording sheet by conduction from the fuser roller, which allows for designing a compact fixing device with reduced energy consumption.

However, the conventional method does not address the thermal instability caused by locally heating the fixing belt at the fixing nip, as is the case with the conventional fixing device. Further, this method involves a fixing roller that exhibits a relatively high heat capacity and therefore takes time to heat up to a desired processing temperature, leading to a longer warm-up time. Hence, although designed to provide an increased thermal efficiency through use of an elastically deformable fuser roller, the conventional method fail to provide satisfactory fixing performance for high-speed, on-demand applications.

To cope with the problems of the fixing device using a cylindrically looped, rotatable fixing belt, several methods have been proposed.

For example, one conventional method proposes a fuser assembly that employs a stationary tubular belt holder of thermally conductive material around which a fuser belt is retained in its generally cylindrical shape. The belt holder is equipped with a resistive heater such as a ceramic heater disposed inside the tube so as to heat the entire length of fuser belt rotating around its circumference.

According to this method, the thermal belt holder, which is formed by bending a thin sheet of metal into a tubular configuration, can swiftly conduct heat to the fuser belt, while guiding substantially the entire length of the belt along the outer circumference thereof. Compared to a stationary heater or heated roller that locally heats the fuser belt or film solely at the fixing nip, using the thin-walled conductive belt holder allows for heating the fuser belt swiftly and uniformly, resulting in shorter warm-up times which meet high-speed, on-demand applications.

One drawback encountered when using a tubular belt holder to heat a fuser belt is the difficulty in maintaining uniform spacing between the fuser belt and the belt holder. That is, the elastic fuser belt during rotation occasionally moves too far from the surface of the belt holder to conduct appropriate amounts of heat from the belt holder to the fuser belt. The lack of conduction can cause the metal-based belt holder to locally overheat and burn, resulting in an increased torque of the fuser belt rotating along the damaged surface.

Another conventional method employs a cylindrically looped fuser belt paired with a pressure roller pressed against the fuser belt to form a fixing nip, as well as a stationary, resistive heater in the form of a thin-walled pipe of metal that exhibits a certain resistivity to generate heat when electrified. The resistive heater is installed within the loop of fuser belt with a small spacing in a radial direction, so that their adjoining surfaces do not press against each other, and radiates heat over the entire length of the fuser belt rotating around the metal pipe.

According to this method, holding the fuser belt in close proximity with the resistive heater allows for good imaging performance at high processing speeds, which results in shorter warm-up time and first-print time of the belt-based fixing device. Moreover, keeping the fuser belt and the resistive heater slightly apart prevents abrasion and other concomitant failure of the fuser belt and the resistive heater in high-speed applications.

Unfortunately, this method has a difficulty in that the metal-based resistive heater can wear and break as it undergoes repeated flexion or stress caused by rotational vibration transmitted from the pressure roller through the fuser belt. Once broken, the resistive heater no longer gives off sufficient heat to the fuser belt, resulting in defective fusing performance of the fixing device. Moreover, positioning the resistive heater in close proximity with the fuser belt, although intended to promote heat transfer therebetween, does not allow sufficient heat to be conveyed to the fuser belt uniformly and consistently, leading to long warm-up time and high energy consumption during operation of the fixing device.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a stationary tubular belt holder, a rotatable flexible fuser belt, a contact member, a pressure member, and a heater. The tubular belt holder extends in an axial direction thereof. The fuser belt is looped into a generally cylindrical configuration around the belt holder extending in the axial direction of the belt holder. The tubular belt holder retains the fuser belt in shape as the belt rotates in a circumferential direction of the belt holder. The contact member extends in the axial direction of the belt holder, accommodated in the belt holder inside the loop of the fuser belt. The pressure member extends in the axial direction, disposed opposite the belt holder with the fuser belt interposed between the contact member and the pressure member. The pressure member presses against the contact member through the fuser belt to form a fixing nip through which a recording medium travels in a conveyance direction under heat and pressure. The heater is disposed adjacent to the belt holder to heat directly or indirectly a predetermined circumferential portion of the fuser belt upstream from the fixing nip in the circumferential direction. The belt holder includes a first circumferential section and a second circumferential section. The first circumferential section faces the heated portion of the fuser belt, and defines part of an imaginary, substantially perfect cylindrical surface whose curvature is substantially constant. The second circumferential section faces upstream from the heated portion of the fuser belt in the circumferential direction, and extends radially outward from the imaginary cylindrical surface.

Other exemplary aspects of the present invention are put forward in view of the above-described circumstances, and provide a novel image forming apparatus.

BRIEF DESCRIPTION OF THE DRAWINGS

Amore complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
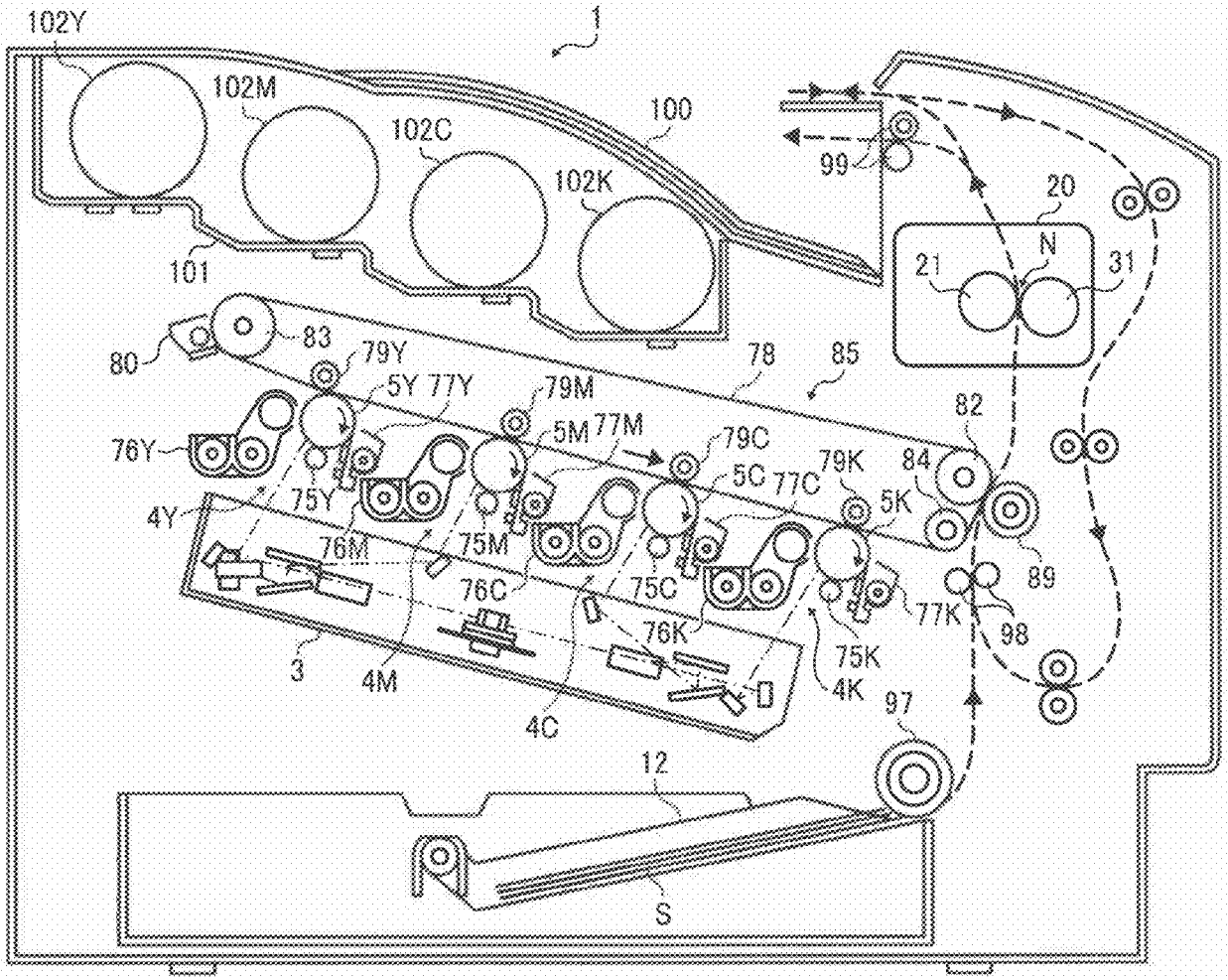
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of the toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
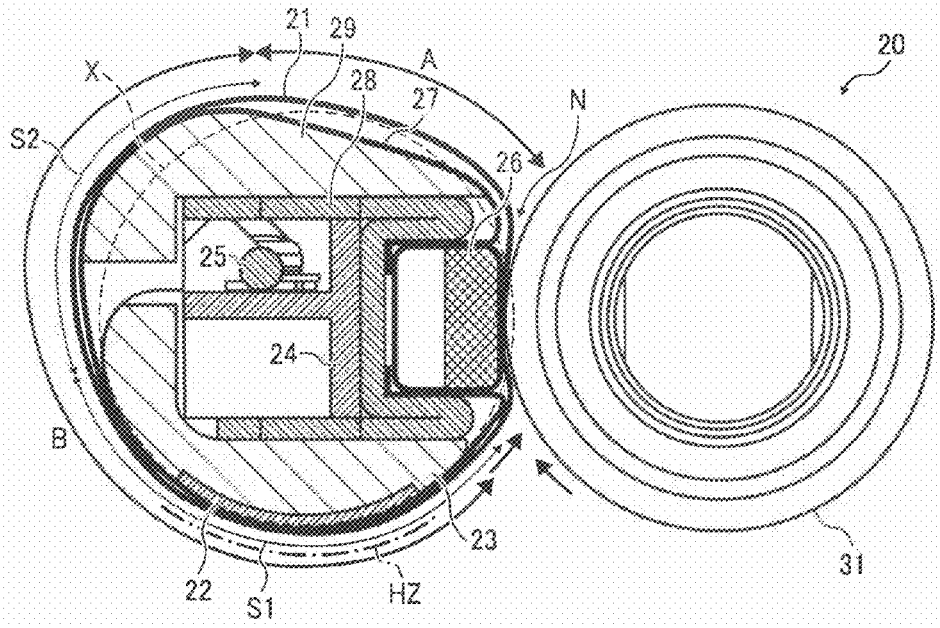
FIG. 2 is an end-on, axial cutaway view schematically illustrating a first embodiment of the fixing device according to this patent specification.

FIG. 2 is an end-on, axial cutaway view schematically illustrating a first embodiment of the fixing device 20 incorporated in the image forming apparatus 1 according to this patent specification.

As shown in FIG. 2, the fixing device 20 includes a stationary, generally cylindrical, tubular sleeve holder 27; a rotatable, flexible fuser sleeve or belt 21 looped into a generally cylindrical configuration around the sleeve holder 27 for rotation in a circumferential direction; an elongated contact pad 26 accommodated in the sleeve holder 27 inside the loop of the fuser sleeve 21; and a generally cylindrical, rotatable pressure roller 31 disposed opposite the sleeve holder 27 with the fuser sleeve 21 interposed between the contact pad 26 and the pressure roller 31, all of which extend in an axial, longitudinal direction perpendicular to the sheet of paper on which the FIG. is drawn. The pressure roller 31 is equipped with a biasing mechanism, not shown, that presses the pressure roller 31 against the contact pad 26 via the fuser sleeve 21 to form a fixing nip N therebetween.

Figure 3A:
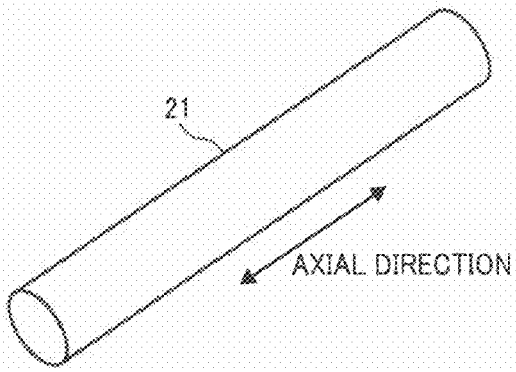
FIGS. 3A and 3B illustrate directional terms applied to the fixing device in this patent specification.
Figure 3B:
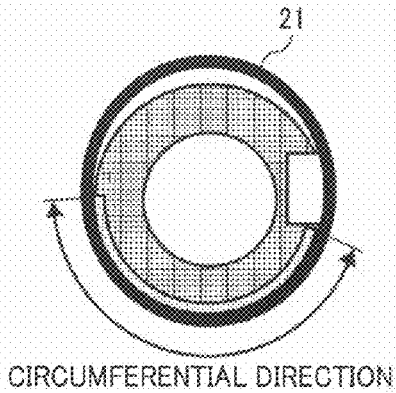

As used herein, the term "axial direction" refers to a direction parallel to a longitudinal, rotational axis around which rotates a generally cylindrical body, in particular, the fuser sleeve 21, as illustrated in FIG. 3A. The term "circumferential direction" refers to a direction along a circumference of a generally cylindrical body, in particular, that of the fuser sleeve 21 or of the sleeve holder 27, as illustrated in FIG. 3B. These directional terms apply not only to the fuser sleeve 21 itself but also to its associated structures, either in their operational position after assembly or in their original forms before or during assembly.

Further, as used herein, the term "maximum compatible width" refers to a maximum width of a recording sheet S that the fixing device 20 can accommodate through the fixing nip N. Unless specifically indicated otherwise, this term is used to describe the dimensions of recording sheet, in particular the width or length of the recording sheet along the axial direction of the fuser sleeve 21 at the fixing nip N.

With continued reference to FIG. 2, inside the loop of the fuser sleeve 21 is a heater 22 disposed on a heater support 23 for holding the heater 22 in position and adjacent to the inner circumference of the fuser sleeve 21 to heat the fuser sleeve 21. In the present embodiment, the heater 22 comprises a planar, laminated heat generator 22S in the form of a thin flexible sheet that stays flat when disassembled and can be bent into a desired configuration upon assembly. The heat generator 22S is held in contact with the inner circumference of the fuser sleeve 21 via an opening or window 27*a* defined in the sleeve holder 27 to heat the fuser sleeve 21 directly by conduction.

The tubular sleeve holder 27 accommodates various pieces of fuser equipment that together constitute an internal structure of the fuser sleeve 21, each of which is positioned on a core mount formed by a combination of a first mounting stay 28 shaped in the letter "H" in axial cross-section and a second mounting stay 24 shaped in the letter "T" in axial cross-section. For example, the heater support 23 for holding the heater 22 in position and an optional, insulative support 29 for supporting the tubular holder 29 are disposed on the outside of the first mounting stay 28 opposite to each other, each defining a curved surface along the inner circumference of the sleeve holder 27. Wiring 25 extends along the second mounting stay 24 to supply the heater 22 with electricity from an external or internal power source, not shown.

During operation, upon initiation of image formation processes in response to a print request input by a user manipulating an operating panel or transmitted via a computer network, the biasing mechanism causes the pressure roller 31 to press against the contact pad 26 through the fuser sleeve 21. With a fixing nip N thus established, a rotary drive motor activates the pressure roller 31 to rotate clockwise in the drawing, which in turn rotates the fuser sleeve 21 counterclockwise in the drawing around the sleeve holder 27. The fuser sleeve 21 during rotation tightens upstream from the fixing nip N in the circumferential direction to establish sliding contact with the heat generator 22.

According to this patent specification, the tubular sleeve holder 27 is specially shaped so as to impart proper tension to the fuser sleeve 21 upstream from the fixing nip N in the circumferential direction, which allows the inner surface of the sleeve 21 to contact and slide against the heat generator 22S consistently and uniformly at least where the heat generator 22S is exposed through the opening 27*a* of the sleeve holder 27. A detailed description of the special configuration of the sleeve holder 27 and its relevant structure will be given later with additional reference to FIG. 11 and subsequent drawings.

Meanwhile, the power source starts supplying electricity to the heater 22 via the wiring 25. The heater 22, having its heating element 22S thus electrified, generates heat for immediate and efficient conduction to the fuser sleeve 21 held in direct contact therewith. Initiation of the heater power supply may be simultaneous with activation of the rotary drive motor. Alternatively, the two events precede or follow each other with an appropriate interval of time depending on specific configuration.

Power supply to the heater 22 is adjusted according to readings of a thermometer disposed either in contact with or spaced apart from the fuser sleeve 21, which heats the fixing nip N to a given processing temperature and maintains sufficient heat for processing an incoming print job.

Thereafter, a recording sheet S bearing an unfixed, powder toner image T enters the fixing device 20 with its front, printed face brought into contact with the fuser sleeve 21 and bottom face with the pressure roller 31. The recording sheet S moves along the rotating surfaces of the fuser sleeve 21 and the pressure roller 31 through the fixing nip N, where the fuser sleeve 21 heats the incoming sheet S to fuse and melt the toner particles, while the pressure roller 31 presses the sheet S against the contact pad 26 to cause the molten toner to settle onto the sheet surface. As the toner image T is thus fixed in place through the fixing nip N, the recording sheet S is forwarded to exit the fixing device 20.

After exit of the recording sheet S, the drive motor stops rotation of the pressure roller 31 and the fuser sleeve 21 where there is no subsequent print request. At the same time, the power supply to the heater 22 turns off where the fixing device operates in a normal or sleep mode to conserve power. Contrarily, where the fixing device is in a standby mode, the power supply to the heater 22 may continue to keep the fuser sleeve 21 at a certain moderate temperature so as to immediately return to operation upon receiving a future print request.

In the present embodiment, the fuser sleeve 21 comprises an endless, flexible belt looped into a generally cylindrical or pipe-like configuration having a length dimensioned according to a width of recording sheet S accommodated through the fixing nip N. For example, the fuser sleeve 21 may be a multilayered endless belt having an outer diameter of approximately 30 mm in its looped, generally cylindrical configuration, consisting of a substrate of metal approximately 30 μm to approximately 50 μm thick, covered at least by an outer layer of release agent approximately 50 μm thick deposited thereupon.

The substrate of the fuser sleeve 21 may be formed of a thermally conductive metal, such as iron, cobalt, nickel, or an alloy of such metals. The release layer of the fuser sleeve 21 may be formed of a fluorine compound such as tetra fluoro ethylene-perfluoro alkylvinyl ether copolymer or perfluoroalkoxy (PFA), polytetrafluoroethylene (PTFE), polyimide (PI), polyetherimide (PEI), polyethersulfide (PES), or the like, approximately 10 μm to approximately 50 μm thick, which allows good release of toner where the fuser sleeve 21 comes into contact with the toner image T on the recording sheet S.

The pressure roller 31 comprises a cylindrical roller formed of a hollowed core of metal, such as aluminum or copper, covered with an intermediate layer of elastic, thermally insulating material, such as silicone rubber or other solid rubber, approximately 2 mm to approximately 3 mm thick, and an outer layer of release agent, such as a PFA layer formed into a tubular configuration, approximately 50 μm thick, deposited one upon another. The pressure roller 31 is equipped with a drive motor that imparts rotation to the roller 31 upon activation. Optionally, the pressure roller 31 may have a dedicated heater, such as a halogen heater, accommodated inside the hollow of the metal core.

The contact pad 26 comprises an elongated elastic member extending in the axial direction, having at least its front side (i.e., the side facing the pressure roller 31 via the fuser sleeve 21) formed of thermally insulating, elastic material such as fluorine rubber. The elastic front face of the contact pad 26 conforms to the circumference of the pressure roller 31 pressed against the contact pad 26, so that the fuser sleeve 21 defines a concave configuration curving inward to the contact pad 26 along which a recording sheet S moves through the fixing nip N. For good slidability and wear resistance, this front face is preferably formed of low-frictional, anti-abrasive material, such as a sheet of PTFE, commercially available under the trademark Teflon®.

The first mounting stay 28 comprises an elongated piece of rigid material extending across the axial length of the fuser sleeve 21, such as a bent sheet of metal obtained through metalworking processes, consisting of a pair of opposed, parallel side walls and a central wall perpendicular to the side walls, positioned generally centrally within the cylindrical sleeve 21.

The first mounting stay 28 accommodates and supports the contact pad 26 facing the pressure roller 31 between its parallel side walls, with the front face of the contact pad 26 protruding toward the pressure roller 31 slightly beyond the edges of the stay 28. Such positioning protects the contact pad 26 from substantial deformation under nip pressure from the pressure roller 31, while maintaining the stay 28 away from contact with the fuser sleeve 21.

The first mounting stay 28 also supports the heater support 23 attached to outside of its side wall, facing approximately half the inner circumference of the fuser sleeve 21 upstream of the fixing nip N. Mounting the heater support 23 may be accomplished either by adhesive bonding to the stay 28 for ease of assembly, or by some other connecting mechanism without adhesion to the stay 28 for eliminating undesirable heat conduction from the heater support 23 to the stay 28.

The second mounting stay 24 comprises an elongated piece of material extending across the axial length of the fuser sleeve 21, consisting of a pair of flanges perpendicular to each other, one fitted between the two side walls of the stay 28, and the other extending parallel to the side walls of the stay 28, along which the wiring 25 lies electrically connecting the heater 22.

The heater support 23 comprises a rigid, partially cylindrical piece of heat-resistant, thermally insulating material. When mounted in position, the heater support 23 has its curved surface extending along a given section of the inner circumference of the tubular sleeve holder 27 holding the fuser sleeve 21 in its generally cylindrical configuration, so that the heater 22 supported thereon lies in contact or close proximity with the fuser sleeve 21.

The heater support 23 may be of any thermal insulator that exhibits high heat resistance to resist heat generated by the heater 22, high mechanical strength to support the heater 22 without deformation upon contacting the rotating fuser sleeve 21, and good insulation performance to thermally isolate the stay 28 from the heater 22 for promoting heat transfer from the heater 22 to the fuser sleeve 21. For example, the heater support 23 may be configured as a molded piece of polyimide resin foam to obtain sufficient strength and immunity against deformation, particularly where the heater 22 operates in continuous contact with the rotating surface of the fuser sleeve 21 and therefore is subjected to strain toward the fixing nip N. For further reinforcement, the heater support 23 may be optionally equipped with an internal reinforcement formed of solid resin.

Figure 4:
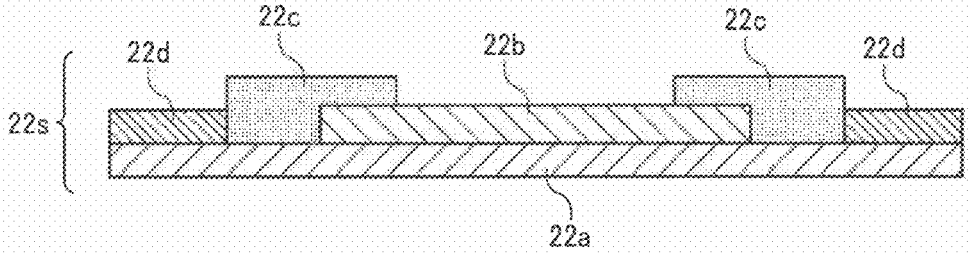
FIG. 4 is a cross-sectional view schematically illustrating a configuration of a laminated heat generator employed in the fixing device of FIG. 2.

As mentioned earlier, the heater 22 in the present embodiment comprises a planar, laminated heat generator 22S in the form of a thin flexible sheet. With reference to FIG. 4, which is a cross-sectional view schematically illustrating a configuration of the laminated heat generator 22S, the heat generator 22S is shown consisting of a substrate 22*a* of an electrically insulative material, on which are deposited a resistive heating layer 22*b* of heat-resistant material and an electrode layer 22*c* of conductive material adjoining each other to form heating circuitry, as well as an insulation layer 22*d* of an electrically insulative material for isolating the heating circuitry from adjacent electrode layers and other electrical components. The heat generator 22S also has a set of electrode terminals 22*e* at opposed longitudinal ends to conduct electricity from the wiring 25 to the heating circuitry, which is presented later in FIG. 5 and subsequent drawings.

Specifically, the substrate 22*a* is a thin, elastic film of heat-resistant resin such as polyethylene terephthalate (PET), and preferably, polyimide resin for obtaining sufficient heat-resistance, electrical insulation, and flexibility.

The resistive heating layer 22*b* is a thin, conductive layer of composite material that exhibits a certain resistivity so as to generate Joule heat when supplied with electricity. For example, the resistive heating layer 22*b* may be a thin, conductive film of a heat-resistant resin such as polyimide containing uniformly dispersed particles of conductive material, such as carbon or metal, obtained by coating the substrate 22*a* with a precursor of heat-resistant resin mixed with a dispersion of conductive material. Alternatively, instead, the resistive heating layer 22*b* may be a laminated layer of heat-resistant material and conductive material, obtained by coating the substrate 22*a* initially with a conductive layer and then with a metal layer deposited thereon.

Conductive materials suitable for use in the resistive heating layer 22*b* include carbon, either in the form of carbon black particles or in the form of nano- or micro-particles consisting at least one of carbon nano-fiber, carbon nanotube, and carbon micro-coil, as well as metal, such as silver, aluminum, or nickel, in the form of particles or filaments.

The electrode layer 22*c* may be obtained by depositing a paste of conductive material, such as conductive ink or silver, or by attaching a foil or mesh of metal to the surface of the substrate 22*a*. The insulating layer 22*d* may be obtained by depositing the same insulating material used to form the substrate 22*a*, such as polyimide resin.

The laminated heat generator 22S is obtained by depositing different materials one upon each other on the substrate 22*a*. That is, the substrate 22*a* is subjected initially to a deposition of resistive material to form the resistive heating layer 22*b*, then to a deposition of heat-resistant, insulating resin to form the insulation layer 22*d*, and finally to a deposition of conductive paste to form the electrode layer 22*c*, with each material being deposited through a patterned mask which exposes only a portion of the substrate or previously deposited film to form the resulting layer in a desired configuration.

The heat generator 22S as a whole is a substantially smooth, thin flexible sheet approximately 0.1 mm to approximately 1 mm thick that exhibits a certain flexibility so as to conform to the curved surface of the heater support 23 when assembled. The heat generator 22S is dimensioned depending on specific configurations of the fuser sleeve 21, for example, approximately 20 cm in the axial direction and approximately 2 cm in the circumferential direction.

It should be noted that although the embodiment depicted in FIG. 2 shows the laminated heat generator 22S positioned approximately 90° displaced from the fixing nip N in the circumferential direction, the heat generator 22S may be provided at any position from opposite the fixing nip N toward entry of the fixing nip N in the circumferential direction, and the position, shape, and dimensions of the heat generator may be otherwise than as specifically depicted herein.

In such a configuration, the laminated heat generator 22S exhibits a relatively low heat capacity and therefore can rapidly produce a desired amount of heat upon activation, which can be adjusted by varying volume resistivity of the resistive heating layer 22*b*, or more precisely, by varying the type, shape, size, and dispersion of conductive particles used in the resistive heating layer 22*b*. For example, a rectangular heat generator approximately 20 cm wide and approximately 2 cm long formed of a material that produces approximately 35 watts per square centimeter ($W/cm^2$) yields a total of approximately 1,200 W output when electrified.

The resin-based heat generator 22S is highly durable compared to other types of heat generator, such as those formed of filaments of stainless steel or other metal. One reason is that the resin-based flexible sheet can withstand repeated flexion or stress caused by rotational vibration transmitted as the pressure roller 31 rotates during operation. Another reason is that the substantially smooth surface of the resin-based sheet is resistant to wear when sliding against the rotating fuser sleeve 21, compared to a rough, irregular surface formed of metal filaments which is susceptible to abrasion when operated in sliding contact with the inner circumference of the fuser sleeve 21. Further resistance against sliding wear can be obtained by providing an outer coating of lubricant such as fluorine resin over the resistive heating layer 22*b*.

Preferably, the laminated heat generator 22S may have multiple heating elements operated independent of each other to heat different portions of the fuser sleeve 21 along the longitudinal axis, which enables the fixing device 20 to properly heat different sizes of recording sheet S without overheat or undue consumption of energy. Such arrangement of the laminated heat generator 22S is described below with reference to FIGS. 5 through 8.

Figure 5:
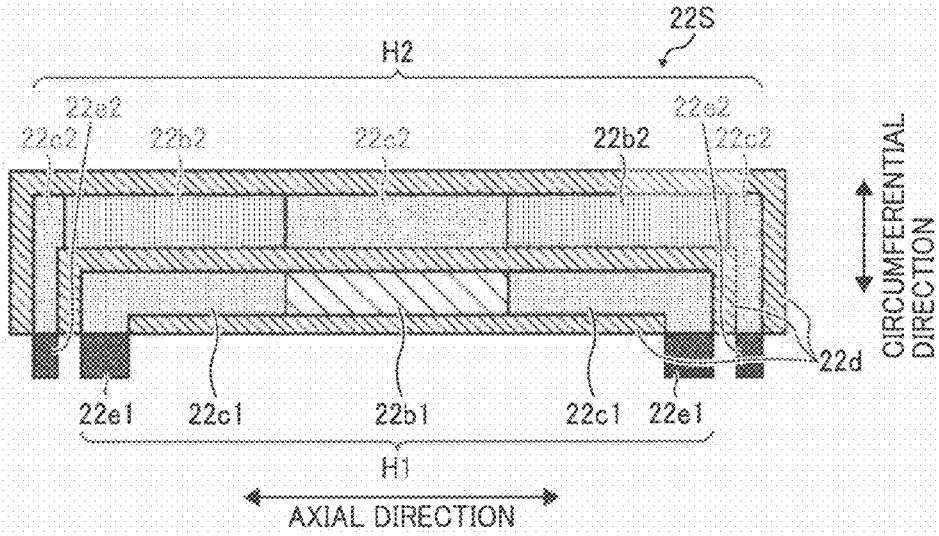
FIG. 5 is a plan view schematically illustrating one embodiment of the laminated heat generator of FIG. 4 before assembly.

As shown in FIG. 5, which is a plan view schematically illustrating one embodiment of the laminated heat generator 22S in its original, disassembled form before assembly, the laminated heat generator 22S has its entire operational area primarily divided in the axial direction into two primary sections electrically insulated from each other by the insulating layer 22*d* forming insulating regions, with each primary section being further divided in the circumferential direction to form a total of six subsections, within which the resistive heating layer 22*b* and the electrode layer 22*c* are deposited to form a resistive region and a conductive region, respectively.

Table 1 below shows the six subsections of the laminated heat generator 22S as entries of a 2-by-3 matrix, positioned relative to those of the fuser sleeve 21, in which the row represents position in the circumferential direction, with "1" denoting a first side farther from the fixing nip N and "2" denoting a second side closer to the fixing nip N, and the column represents position in the axial direction, with "1" and "3" denoting a pair of axial ends opposed to each other, and "2" denoting an axial center between the opposed axial ends.

TABLE 1

Subsections of the laminated heat generator

| | | Axial | | |
|---|---|---|---|---|
| | | First end | Center | Second end |
| Circumferential | Second side | (2, 1) | (2, 2) | (2, 3) |
| | First side | (1, 1) | (1, 2) | (1, 3) |

Specifically, the laminated heat generator 22S includes a pair of first and second heating circuits H1 and H2, each extending across three sub-sections in the axial direction on one circumferential side. The heating circuits H1 and H2 operate independently of each other with the insulation regions 22*d* provided between and around the heating circuits H1 and H2 to prevent short-circuiting across the heat generator 22S.

More specifically, the first heating circuit H1 consists of a first resistive region 22*b*1 formed in the subsection (1, 2) and first conductive regions 22*c*1 formed in the subsections (1, 1) and (1, 3) on the opposed sides of the subsection (1, 2), with a first pair of electrode terminals 22*e*1 connected to the opposed conductive regions 22*c*1. The second heating circuit H2 consists of second resistive regions 22*b*2 formed in the subsections (2, 1) and (2, 3) and second conductive regions 22*c*2 formed in the subsection (2, 2) as well as in the subsections (2, 1) and (2, 3), with a second pair of electrode terminals 22*e*2 connected to the opposed conductive regions 22*c*2.

In such a configuration, the heat generator 22S can selectively heat the subsection (1, 2) corresponding to the axial center of the fuser sleeve 21 by activating the first heating circuit H1 with power supplied across the first pair of electrode terminals 22*e*1, which causes the resistive region 22*b*1 to generate Joule heat, leaving the conductive regions 22*c* therearound substantially unheated.

By contrast, the heat generator 22S can selectively heat the subsections (2, 1) and (2, 2) corresponding to the opposed axial ends of the fuser sleeve 21 by activating the second heating circuit H2 with power supplied across the second pair of electrode terminals 22*e*2, which causes the resistive regions 22*b*2 to generate Joule heat upon activation, leaving the conductive regions 22*c*2 therearound substantially unheated.

Thus, the laminated heat generator 22S can selectively heat intended portions of the fuser sleeve 21 by activating corresponding one(s) of the multiple heating elements H1 and H2 that operate independently of each other. Such selective heating capability of the heat generator 22S enables the fixing device 20 to efficiently accommodate different sizes of recording sheet S for thermal processing through the fixing nip N.

For example, to process a small-sized, narrow recording sheet through the fixing nip N, the fixing device 20 activates solely the first heating circuit H1 by energizing the first electrode terminals 22*e*1, or alternatively, both the first and second heating circuits H1 and H2 by energizing the first electrode terminals 22*e*1 and 22*e*2, the former with greater power supply than the latter. The first heating circuit H1 thus activated selectively heats the axial center of the fuser sleeve 21 where fixing process takes place upon entry of the narrow recording sheet.

By contrast, to process a large-sized, wide recording sheet through the fixing nip N, the fixing device 20 activates both the first and second heating circuits H1 and H2 by energizing the first electrode terminals 22*e*1 and 22*e*2. The first and second heating circuits H1 and H2 thus activated heat the entire length of the fuser sleeve 21 where fixing process takes place upon entry of the wide recording sheet.

Heating the fuser sleeve 21 by activating either or both of the multiple heating elements H1 and H2 depending on the size of recording sheet S in use results in reduced power consumed by the fixing device 20. In particular, selectively using the first heating element H1 in processing small-sized sheets in succession prevents excessive heating of non-operating portions of the fuser sleeve 21, which would otherwise trigger shutdown for protection against machinery damage, resulting in reduced yields of the fixing device.

Selective heating capability provided by the single, integral heat generator 22S is superior to that provided by separate heating elements formed of different materials, as the multiple heating elements H1 and H2, formed of the same material through the same process during manufacture, exhibit similar thermal properties to ensure the heat generator 22S heats the fuser sleeve 21 uniformly in the axial direction as well as in the circumferential direction.

In the embodiment depicted in FIG. 5, the two resistive regions 22*b*1 and 22*b*2 in the different heating circuits H1 and H2 are completely offset from each other in the axial direction. Alternatively, instead, the laminated heat generator 22S may be arranged to have the resistive regions 22*b*1 and 22*b*2 only partially offset, that is, contiguous with and/or adjacent to each other through the insulation region 22*d*.

Figure 6:
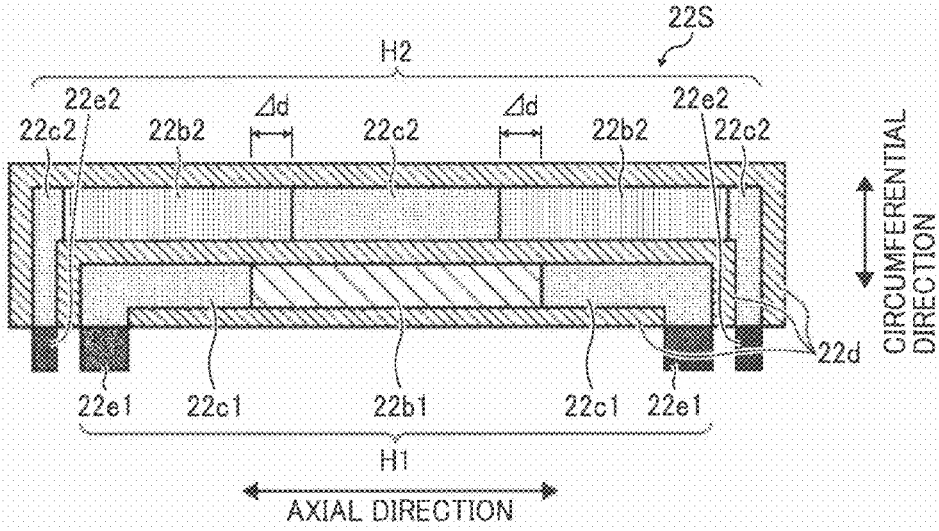
FIG. 6 is a plan view schematically showing one arrangement of the laminated heat generator of FIG. 4.

For example, as shown in FIG. 6, the heat generator 22S may have the first and second resistive regions 22*b*1 and 22*b*2 formed in substantially rectangular shapes contiguous with each other through the insulation region 22*d* therebetween, so that when energized, the first and second heating circuits H1 and H2 heat one or more common areas of the fuser sleeve 21 each of which has a length Δd in the axial direction.

Such arrangement is effective where heat generated by the resistive regions 22*b* dissipates into the insulating regions 22*d* and the conductive regions 22*c* which are thermally conductive, so that the resistive regions 22*b* tend to provide higher amounts of heat at their center than at their side edges for transfer to the fuser sleeve 21. With the two resistive regions 22*b*1 and 22*b*2 completely offset and non-contiguous with each other, such tendency results in unstable heat across the fuser sleeve 21 causing imperfections in printed images, in which those portions corresponding to the adjoining edges of the resistive regions 22*b* remain cooler than other, adjacent portions of the fuser sleeve 21.

By contrast, in the arrangement of FIG. 6, the contiguous resistive regions 22*b*1 and 22*b*2 can heat the fuser sleeve 21 in conjunction with each other at their adjoining edges where the amount of heat yielded by each heating element is relatively low, resulting in uniform heat across the fuser sleeve 21, which leads to higher imaging quality of the fixing device 20.

Figure 7:
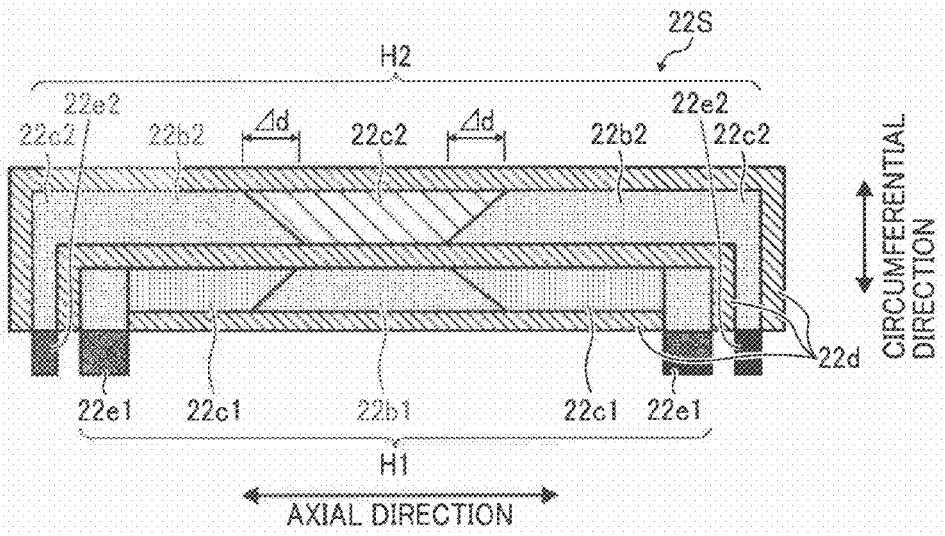
FIG. 7 is a plan view schematically showing another arrangement of the laminated heat generator of FIG. 4.

Further, as shown in FIG. 7, the heat generator 22S may have the resistive regions 22*b*1 and 22*b*2 formed in tapered rectangular shapes, instead of square rectangular shapes, adjacent to each other, so that when energized, the first and second heating circuits H1 and H2 heat one or more common areas of the fuser sleeve 21 each of which has a length Δd in the axial direction.

As in the embodiment depicted in FIG. 6, the contiguous resistive regions 22*b*1 and 22*b*2 can heat the fuser sleeve 21 in conjunction with each other at their adjoining edges where the amount of heat yielded by each heating element is relatively low, resulting in uniform heat across the fuser sleeve 21, which leads to higher imaging quality of the fixing device 20.

Moreover, in the arrangement of FIG. 7, the resistive regions 22*b*1 and 22*b*2 have their depths or dimensions along the circumference varying in the axial direction, so that the ratio of their depths varies constantly in the axial direction. Compared to a configuration in which the ratio of the depths of the resistive regions 22*b*1 and 22*b*2 is fixed, varying the depths of the resistive regions 22*b*1 and 22*b*2 allows for adjusting heat distribution across the fuser sleeve 21 and cancelling out undesired process variations of the heat generator 22S, in particular, those in the axial dimension Δd, which would otherwise result in unstable heat across the fuser sleeve 21.

As mentioned, the laminated heat generator 22S is obtained by depositing different materials one upon each other on the substrate 22*a*, each through a patterned mask which exposes only a portion of the substrate or previously deposited film to form the resulting layer in a desired configuration. Thus, using suitable deposition techniques, the laminated heat generator 22S may be arranged to have different configurations of resistive and conductive regions by adjusting the shapes of masks used in successive deposition processes.

Figure 8:
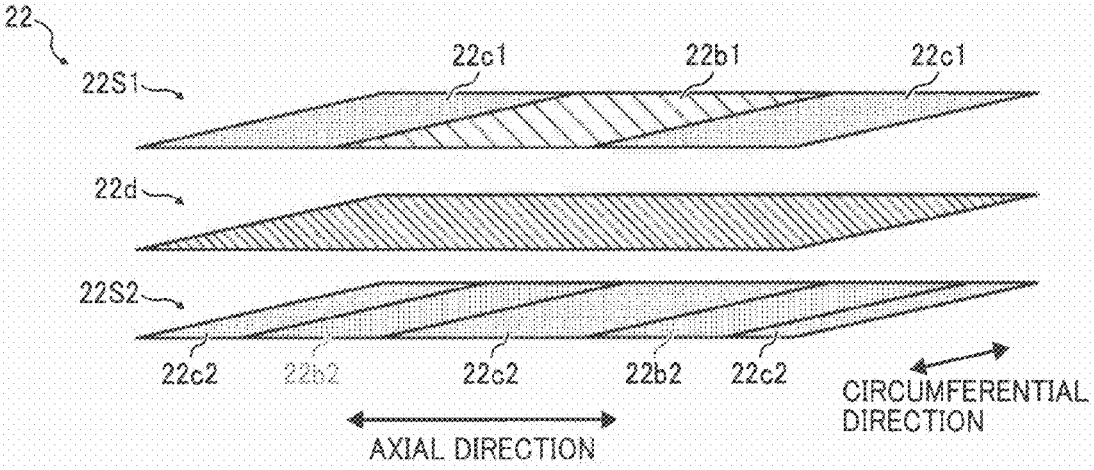
FIG. 8 is an exploded, perspective view showing a further embodiment of the laminated heat generator.

In a further embodiment, the laminated heat generator 22S may have a multilayered structure obtained by combining multiple layers each forming a single heating circuit. FIG. 8 is an exploded, perspective view showing such embodiment of the laminated heat generator 22S.

As shown in FIG. 8, the laminated heat generator 22S includes a pair of first and second layers 22*s*1 and 22*s*2 superimposed one atop another, with an insulation layer 22*d* interposed therebetween.

Specifically, the first layer 22*s*1 has its operational area generally divided into three sections along the axial direction to form a first heating circuit H1, consisting of a first resistive region 22*b*1 formed in the central section, and first conductive regions 22*c*1 formed in the sections on the opposed sides of the operational area.

The second layer 22*s*2 has its operational area divided into five sections along the axial direction to form a second heating circuit H2, consisting of second resistive regions 22*b*2 formed in two sections on the opposed sides of the central section, and second conductive regions 22*c*2 formed in the central section and the remaining two sections at the opposed ends of the operational area.

The heating circuits H1 and H2 operate independently of each other with the insulation layer 22*d* provided between the heating circuits H1 and H2 to prevent short-circuiting across the heat generator 22S.

In such a configuration, the laminated heat generator 22S can selectively heat its central section corresponding to the axial center of the fuser sleeve 21 by activating the first heating circuit H1 with power supplied to cause the resistive region 22*b*1 to generate Joule heat, leaving the conductive regions 22*c*1 therearound substantially unheated.

By contrast, the laminated heat generator 22S can selectively heat its sub-central sections corresponding to the opposed axial ends of the fuser sleeve 21 by activating the second heating circuit H2 with power supplied to cause the resistive regions 22*b*2 to generate Joule heat, leaving the conductive regions 22*c*2 therearound substantially unheated.

Thus, as in the embodiments depicted through FIGS. 5 through 7, the laminated planar heat generator 22S can selectively heat intended portions of the fuser sleeve 21 by activating corresponding one (s) of the multiple heating elements H1 and H2 that operate independently of each other.

Moreover, the laminated planar heat generator 22S composed of multiple layers each having its operational area divided only in the circumferential direction provides high heat output with compact size, compared to a configuration where the operational area of the heat generator is divided along both the axial and circumferential directions, which would require a large operational area to generate sufficient heat for high-output application, resulting in too large an overall size of the planar heater to fit into a relatively small fuser sleeve.

Referring back to FIG. 2, the tubular sleeve holder 27 is shown disposed inside the fuser sleeve 21 to support the sleeve 21 rotating therearound, optionally equipped with the thermally insulative, internal support 29 held on the first mounting stay 28 to support the tubular sleeve holder 27 from inside, downstream of the fixing nip N.

In the present embodiment, the tubular sleeve holder 27 comprises a generally cylindrical pipe that has an outer diameter approximately 0.5 mm to approximately 1 mm smaller than the inner diameter of the fuser sleeve 21, formed, for example, of a thin sheet of metal, such as iron or stainless steel, approximately 0.1 mm to approximately 1 mm in thickness.

The tubular sleeve holder 27 has a longitudinal slot in one side thereof, defined by opposed edges bent inward away from the cylindrical circumference, which accommodates the contact pad 26 so that the tubular sleeve holder 27 itself does not contact the fuser sleeve 21 or the pressure roller 31 forming the fixing nip N therebetween. The opposed edges of the longitudinal side slot are clamped together by the first mounting stay 28, which holds the sleeve holder 27 in its tubular configuration.

Upon installation, the sleeve holder 27 has its outer surface in contact with the inner surface of the fuser sleeve 21 at least from opposite the fixing nip N to immediately upstream of the fixing nip N in the circumferential direction. The sleeve holder 27 is held in position with its opposed longitudinal ends supported by opposed sidewalls that constitute a frame or chassis of the fixing device 20.

The insulative support 29 comprises a rigid piece of heat-resistant, thermally insulating material, with its one side defining a curved surface along which the tubular sleeve holder 27 is held in contact with the inner circumference of the fuser sleeve 21. Provision of such insulative support 29 may be omitted depending on the specific configuration.

The insulative support 29 may be of any thermal insulator that exhibits high heat resistance to resist heat emanating from the fuser sleeve 21 through the tubular sleeve holder 27, high mechanical strength to support the tubular sleeve holder 27 without deformation upon contacting the rotating fuser sleeve 21, and good insulation performance to prevent heat from flowing to the interior of the tubular support 27, retaining heat for conduction to the fuser sleeve 21. For example, in the present embodiment the insulative support 29 is configured as a molded piece of polyimide resin foam, as is the case with the heater support 23 described earlier.

In such a configuration, the tubular sleeve holder 27 serves to ensure the fuser sleeve 21 rotates properly even at high rotational speeds during operation. The fuser sleeve 21 during rotation is subjected to different tensions as it passes from upstream to downstream of the fixing nip N. Upstream of the fixing nip N, the fuser sleeve 21 is relatively taut as it is drawn by the pressure roller 31 toward the fixing nip N, with its inner circumference sliding over the heater 22 while pressing against the heater support 23. Conversely, downstream of the fixing nip N, the fuser sleeve 21 is relatively slack as it is relieved of tension from the pressure roller 31. If not corrected, such looseness may adversely affect rotation of the fuser sleeve 21 downstream of the fixing nip N, which can be intolerable where the fuser sleeve 21 rotates at higher rotating speeds for high-speed application.

Provision of the tubular sleeve holder 27 holds the fuser sleeve 21 in its generally cylindrical configuration during rotation, which enables the fuser sleeve 21 to remain taut downstream of the fixing nip N where it might otherwise go slack, thereby leading to more stable operation of the fixing device. Moreover, the rigid, metal holder 27 not only provides mechanical stability during operation, but also facilitates handling of the flexible fuser sleeve 21 held therearound, leading to ready assembly of the fixing device during manufacture.

Figure 9A:
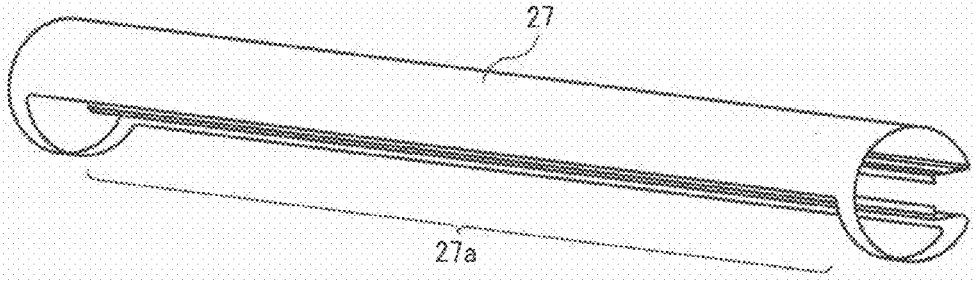
FIG. 9A is a perspective view schematically illustrating a configuration of a tubular sleeve holder before assembly, employed in the fixing device of FIG. 2.
Figure 9B:
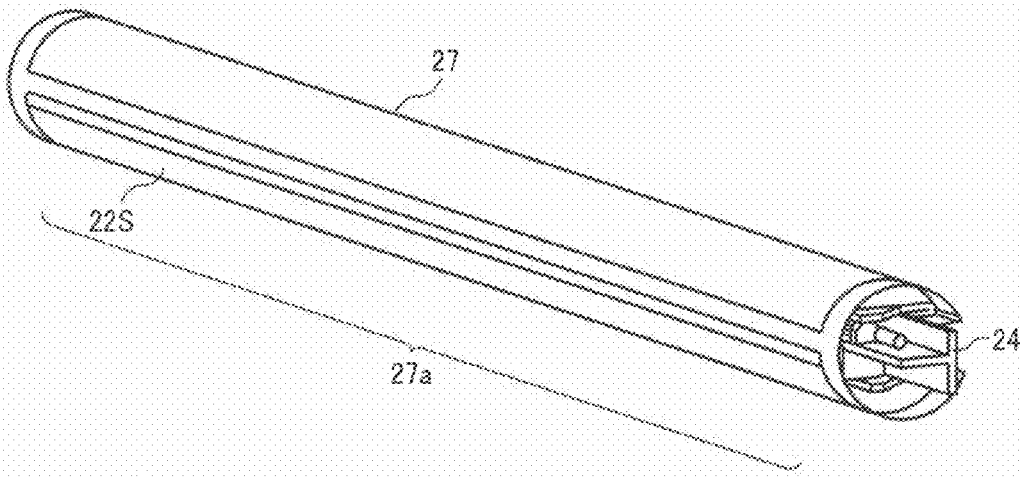
FIG. 9B is a perspective view schematically illustrating the tubular sleeve holder of FIG. 9A during assembly.

FIGS. 9A and 9B are perspective views schematically illustrating a configuration of the tubular sleeve holder 27 before and during, respectively, assembly with the laminated heat generator 22S and its associated structure.

As shown in FIG. 9A, the tubular sleeve holder 27 has the elongated window or opening 27*a* formed by removing a particular portion of the circumference extending in the axial direction, which faces the heat generator 22S upon installation of the fuser assembly. As shown in FIG. 9B, the tubular sleeve holder 27 is assembled with the internal structure of the fuser assembly so that the entire operational area of the heat generator 22S is exposed through the opening 27*a*.

Figure 10:
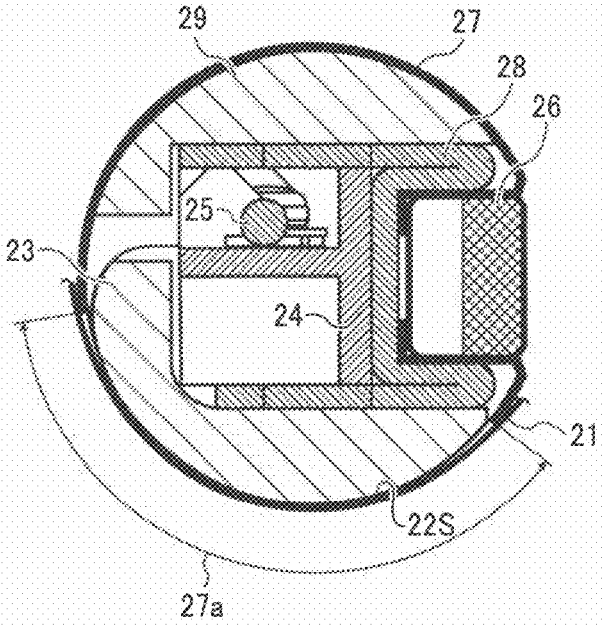
FIG. 10 is an end-on, axial cutaway view schematically illustrating the tubular sleeve holder of FIGS. 9A and 9B upon installation.

With additional reference to FIG. 10, which is an end-on, axial cutaway view schematically illustrating the tubular sleeve holder 27 with the opening 27*a* in the complete fuser assembly, the laminated heat generator 22S is shown exposed through the opening 27*a* of the tubular sleeve holder 27 to the inner surface of the fuser sleeve 21. In this embodiment, the heat generator 22S may have its outer, operational surface extend along, or slightly beyond, the circumferential plane of the tubular sleeve holder 27, rather than being recessed inward from the holder circumference.

Such arrangement allows the laminated heat generator 22S, held on the curved surface of the heater support 23, to establish direct contact with the inner surface of the fuser sleeve 21, which promotes efficient heat transfer from the heat generator 22S to the fuser sleeve 21, leading to high thermal efficiency in heating the fuser sleeve 21 equipped with the tubular sleeve holder 27.

To construct the internal structure of the fuser sleeve 21 as shown in FIG. 10, the laminated heat generator 22S is initially bonded to the curved surface of the heater support 23, with all its electrode terminals 22*e* arranged in the axial direction beyond the edge of the curved surface. Preferably, bonding the heat generator 22S is performed using an adhesive that exhibits low thermal conductivity, to prevent heat from dissipating to the heater support 23 during operation.

After bonding to the heater support 23, the laminated heat generator 22S is bent along the longitudinal edge of the heater support 23 with the electrode terminals 22*e* directed along the flange of the second mounting stay 24 (i.e., radially inward when disposed inside the fuser sleeve 21), followed by fastening the terminals 22*e* to the flange of the second mounting stay 24, for example, using screws inserted through screw-holes provided on the stay flange and the heater terminals.

The mounting stay 24, the heater support 23, and the laminated heat generator 22S thus combined are further combined with the first mounting stay 28, wherein the heater support 23 is positioned with its rear side (i.e., the side opposite the curved surface on which the heat generator 22S is supported) fitting along the outside of the mounting stay 28, followed by inserting the second mounting stay 24 between the opposed sidewalls of the first mounting stay 28 opposite to the side where the contact pad 26 is installed. The combined structure thus obtained is placed together into the tubular sleeve holder 27 to form an integrated, internal structure, which is subsequently inserted into the interior hollow of the fuser sleeve 21 to complete the fuser assembly for installation in the fixing device 20 as shown in FIG. 2.

Note that, in the fuser assembly, the laminated heat generator 22S is fastened to the second mounting stay 24 at one longitudinal edge farthest from the fixing nip N in the circumferential direction. Where the heat generator 22S is not adhesively bonded to the heater support 23, fixing the longitudinal edge of the heat generator 22S causes the fuser sleeve 21 to pull the unfixed, opposite edge of the heat generator 22S toward the fixing nip N as it rotates in the circumferential direction. This in turn causes the heat generator 22S to establish stable contact with the inner circumference of the fuser sleeve 21, which allows for efficient heat transfer form the heat generator 22S to the fuser sleeve 21.

Preferably, the laminated heat generator 22S is fastened to the heater support 23 using suitable adhesive material, such as glue or tape, so as to prevents the heat generator 22S from displacement and concomitant failures of the fuser assembly. In a configuration in which the heat generator has no secure connection with the heater support, the heat generator lifts off the heater support, and therefore is readily displaced as the fuser sleeve 21 rotates backward during repair or maintenance (e.g., for removing a sheet jam), which would result in deformation and breakage of the electrode terminals.

More preferably, the laminated heat generator 22S is attached to the heater support 23 only at its opposed axial ends outboard of the maximum compatible width of recording sheet. Compared to a configuration in which the entire surface of the heat generator is attached to the heater support, such arrangement prevents undesirable transfer of heat from the heat generator 22S to the heater support 23 inboard of the maximum compatible sheet width, resulting in efficient heating of the fuser sleeve 21 with the heat generator 22S while ensuring proper positioning of the heat generator 22S on the heater support 23.

More preferably still, fastening the laminated heat generator 22S to the heater support 23 is performed using a thermally resistant, acrylic or silicone-based, double-sided adhesive tape. Use of double-sided adhesive tape facilitates assembly and disassembly of the heat generator 22S with the heater support 23, in particular, during maintenance or repair where a defective heat generator is removed together with an adhesive material from the heater support, followed by connecting a new or repaired heat generator to the heater support with an adhesive placed therebetween.

Having described the general configuration, a description is now given of specific features of the fixing device 20 that employs the tubular sleeve holder 27 according to this patent specification.

Referring again back to FIG. 2, the heater 22 is shown disposed adjacent to the sleeve holder 27 to heat a particular circumferential portion HZ of the fuser sleeve 21 upstream from the fixing nip N in the circumferential direction. The sleeve holder 27 includes a first circumferential section S1 and a second circumferential section S2, the former facing the heated portion HZ of the fuser sleeve 21 and the latter facing upstream from the heated portion HZ of the fuser sleeve 21 in the circumferential direction.

As mentioned above, the tubular sleeve holder 27 comprises a generally cylindrical metal pipe that has an outer diameter slightly smaller than the inner diameter of the fuser sleeve 21. The tubular sleeve holder 27 has the longitudinal side slot to accommodate the contact pad 26 therein, so that the tubular sleeve holder 27 itself does not contact the fuser sleeve 21 or the pressure roller 31 forming the fixing nip N therebetween.

The sleeve holder 27 forms, together with the fuser pad 26 accommodated in its side slot, a closed curved plane inside the loop of the fuser sleeve 21, whose outer circumference is slightly shorter than the inner circumference of the fuser sleeve 21. Such arrangement allows the fuser sleeve 21 to rotate around the sleeve holder 27 without excessive torque or frictional resistance, which would otherwise result in undue load on the rotary drive and increased energy consumed during operation.

Also as mentioned, the tubular sleeve holder 27 has the elongated window or opening 27*a* through which the heater 22 may have its outer, operational surface extend along, or slightly beyond, the circumferential plane of the tubular sleeve holder 27 to promote efficient heat transfer from the heat generator 22S to the fuser sleeve 21, leading to high thermal efficiency in heating the fuser sleeve 21 equipped with the tubular sleeve holder 27.

Figure 11:
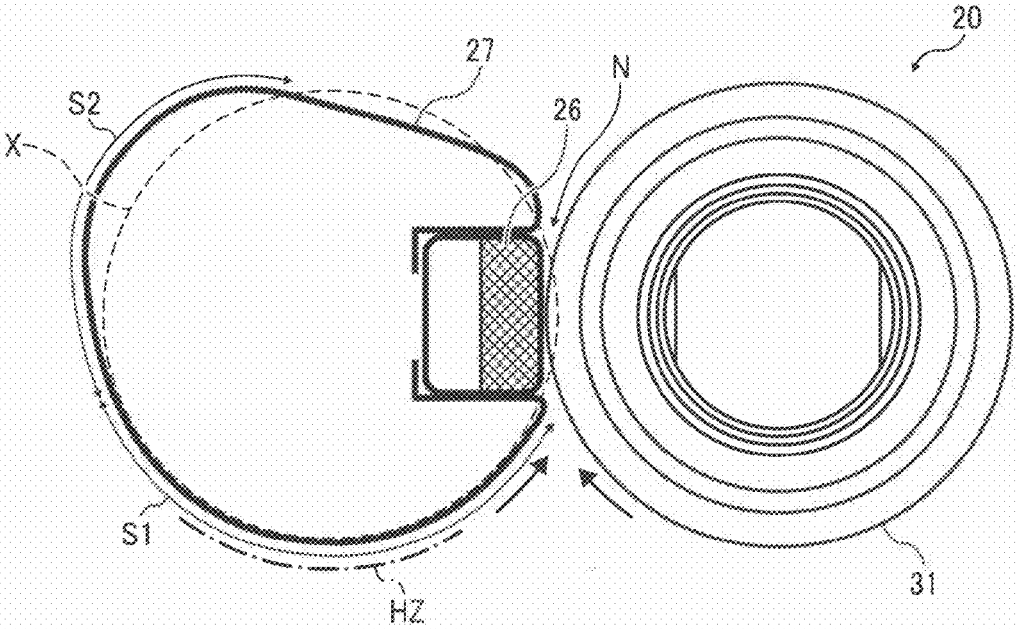
FIG. 11 is another end-on, axial view of the fixing device of FIG. 2, showing with greater clarity a special configuration of the tubular sleeve holder according to this patent specification.

FIG. 11 is another end-on, axial view of the fixing device 20, with the fuser sleeve 21 and several pieces of fuser equipment omitted to show with greater clarity the special configuration of the sleeve holder 27.

As shown in FIG. 11, the tubular sleeve holder 27 comprises a pipe-shaped elongated body extending in its axial direction whose axial cross-section is irregular or asymmetric in shape, that is, does not form a regular, perfect circle of constant curvature.

Specifically, the first circumferential section S1 of the sleeve holder 27, facing the heated portion HZ of the fuser sleeve 21, defines part of an imaginary, substantially perfect cylindrical surface X whose curvature is substantially constant, whereas the second circumferential section S2, facing upstream from the heated portion HZ in the circumferential direction, extends radially outward from the imaginary cylindrical surface X.

The imaginary cylindrical surface X represents a circular cylinder whose curvature (and hence radius of curvature) is approximately equal to that of the fuser sleeve 21 in its cylindrical configuration (i.e., the original shape which the tubular fuser sleeve 21 can retain by its own stiffness before assembly with, or upon removal from, the sleeve holder 27), so that the first circumferential section S1 exhibits a radius of curvature approximately equal to the radius of the fuser sleeve 21 in its original, cylindrical configuration.

With additional reference to FIG. 2, the fuser sleeve 21 is shown entrained around the asymmetric sleeve holder 27 to rotate in the circumferential direction as the motor-driven pressure roller 31 rotates. According to this patent specification, the irregular or asymmetric configuration of the tubular sleeve holder 27 enables the fuser sleeve 21 to stably rotate around the sleeve holder 27, while establishing close contact with the sleeve holder 27 during operation of the fixing device 20.

Specifically, immediately downstream from the fixing nip N in the circumferential direction (indicated by line A in FIG. 2), the fuser sleeve 21 remains relatively slack and comes slightly apart from the sleeve holder 27 as it exits the fixing nip N to proceed toward the second section S2 of the sleeve holder 27. Conversely, upstream from the fixing nip N in the circumferential direction (indicated by line B in the FIG. 2), the fuser sleeve 21 is drawn taut and slides against the sleeve holder 27 as it passes along the second section S2 and then the first section S1 of the sleeve holder 27 to enter the fixing nip N.

The fuser sleeve 21 thus tensioned upstream, but not downstream, from the fixing nip N in the circumferential direction can stably rotate without undue torque or load on the rotary driver of the fixing device 20. Moreover, tensioning the fuser sleeve 21 causes the inner circumference of the fuser sleeve 21 to closely contact the sleeve holder 27 upstream from the fixing nip N in the circumferential direction.

Note that, with the sleeve holder 27 defining the substantially constant curvature S1 to face the heated portion HZ of the fuser sleeve 21 and the irregular curvature S2 protruding radially outward to face upstream of the heated portion HZ, the fuser sleeve 21 can contact and press against the sleeve holder 27 along the heated circumferential portion HZ more closely than would be possible with a simple, perfect cylindrical sleeve holder.

Such close contact or pressure established between the fuser sleeve 21 and the sleeve holder 27 translates into uniform, gapless contact between the fuser sleeve 21 and the heater 22 in the circumferential direction as well as in the axial direction, where the curved operational surface of the heater 22 is exposed via the opening 27*a* of the sleeve holder 27 to the inner circumference of the fuser sleeve 21 at the circumferential portion HZ, as is the case with the present embodiment (see FIG. 10).

Figure 12:
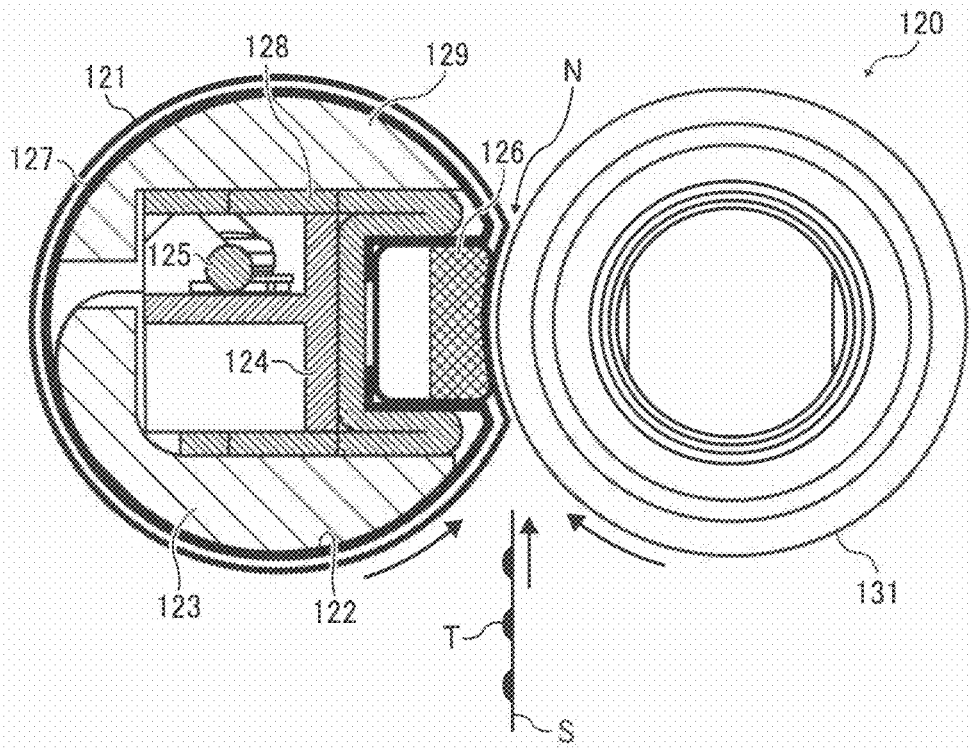
FIG. 12 is an end-on, axial cutaway view schematically illustrating a comparative example of a fixing device.

For comparison purposes, and in order to appreciate the beneficial and non-predictable effects of the present invention, in FIG. 12 a comparative example 120 is presented where the fuser assembly employs a perfect cylindrical sleeve holder 127 instead of an asymmetric tubular sleeve holder.

As shown in FIG. 12, the overall configuration of the fixing device 120 except for the shape of the sleeve holder 127 is similar to that depicted in FIG. 2, wherein a stationary tubular fuser sleeve 121 is paired with a pressure roller 131 pressed against a contact pad 126 via the fuser sleeve 121 to form a fixing nip N, while entrained around the sleeve holder 127 accommodating various pieces of fuser equipment, such as a heater 122, first and second mounting stays 128 and 124, a heater support 123, a holder support 129, heater wiring 125, etc., in its hollow interior.

In this arrangement, the fixing device 120 suffers from variations in temperature of the fuser sleeve 121 in the axial and circumferential directions, due to variations in contact between the fuser sleeve 121 and the heater 122 where the fuser sleeve 121 slackens and separates from the heater 122 upstream from the fixing nip N as it rotates around the cylindrical sleeve holder 127.

Such variations in temperature adversely affect imaging performance of the fixing device 120. For example, where unintended spacing between the fuser sleeve 121 and the sleeve holder 127 results in a reduced total area of contact between the fuser sleeve 121 and the heater 122, transferring heat from the heater 122 to the fuser sleeve 121 requires more time than intended to decelerate warm-up and reduce thermal efficiency. Further, as the heater 122 tends to accumulate heat where it fails to contact the fuser sleeve 121, lack of contact between the fuser sleeve 121 and the sleeve holder 127 can cause localized overheating and concomitant failures of the fuser assembly. Still further, variations in contact pressure between the fuser sleeve 121 and the heater 122 give variations in thermal conductivity therebetween, resulting in uneven distribution of heat across the fuser sleeve 121 to destabilize fusing at the fixing nip N.

In contrast to the comparative example 120, the fixing device 20 according to this patent specification is highly immune to variations in contact pressure between the fuser sleeve and the heater, owing to provision of the asymmetric sleeve holder 27 that maintains close, uniform contact between the fuser sleeve 21 and the heater 22 without unduly increasing frictional resistance or torque therebetween.

Specifically, uniform contact pressure between the fuser sleeve 21 and the heater 22 ensures the heater 22 conducts heat to the fuser sleeve 21 stably and uniformly in the axial and circumferential directions. Such consistent heating of the fuser sleeve 21 results in uniform heat distribution across the fixing nip N, which allows for good fixing performance with uniform gloss across a resulting image, as well as a desired, short warm-up time and low energy consumption of the fixing device 20. Further, maintaining the entire surface of the heater 22 in gapless, consistent contact with the fuser sleeve 21 at the heated circumferential portion HZ prevents localized overheating of the heater 22.

The fuser sleeve 21 entrained around the asymmetric sleeve holder 27 can contact the heater 22 with sufficient pressure to obtain a sufficiently small thermal contact resistance (and hence a large thermal contact conductance) between their adjoining surfaces. Compared to pushing or squeezing the fuser sleeve against the sleeve holder, tightening the fuser sleeve 21 around the asymmetric sleeve holder 27 does not cause an excessively large contact pressure against the heater 22, which would otherwise result in failures due to increased torque or frictional resistance between the heater and the fuser sleeve, such as premature wear of the protective, insulating coating of the resistive heater, or disturbed rotation of the fuser sleeve around the sleeve holder.

Preferably, the first circumferential section S1 of the sleeve holder 27, facing the heated portion HZ of the sleeve 21, extends upstream from the fixing nip N to opposite the fixing nip N across a rotational axis of the fuser sleeve 21 in the circumferential direction. Such arrangement ensures that the fuser sleeve 21 rotates stably while establishing stable contact pressure against the heater 22, which in turn enables the heater 22 to conduct heat to the fuser sleeve 21 stably and uniformly in the axial and circumferential directions, resulting in uniform heat distribution across the fixing nip N.

More preferably, upstream from the second circumferential section S2 in the circumferential direction, the cross-section of the sleeve holder 27 is slightly flattened or oblate compared to the perfect circular cross-section of the imaginary cylindrical surface X, so that the sleeve holder 27 exhibits a greater curvature immediately downstream from the fixing nip N than along the first circumferential section S1 thereof in the circumferential direction. Such arrangement allows for ready stripping of a recording sheet S from the fuser sleeve 21 at the exit of the fixing nip N or past the fuser pad 26.

More preferably still, the fixing device 20 has at least one of the laminated heat generator 22S and the heater support 23 partially recessed to accommodate the thickness of an adhesive material, in particular, double-sided adhesive tape, provided to connect the heat generator 22S to the heater support 23.

Figure 13:
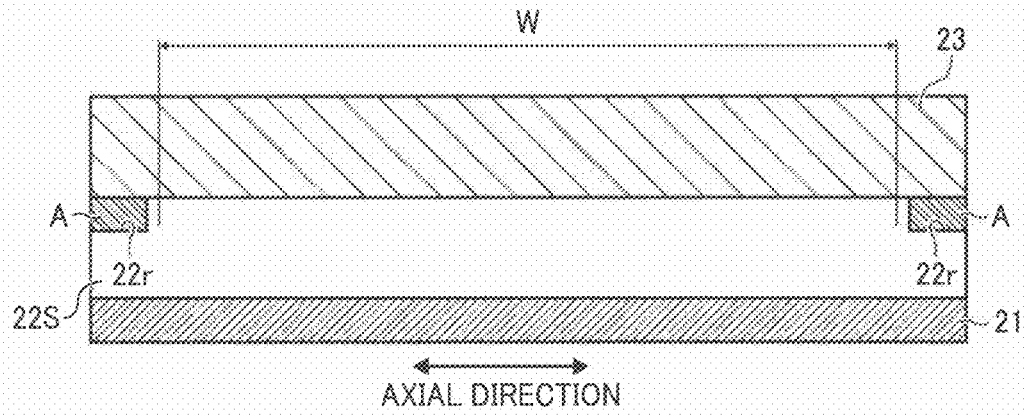
FIG. 13 is a cross-sectional view showing one arrangement of the laminated heat generator, taken along the axial direction of the fuser sleeve.

For example, as shown in FIG. 13, which is a cross-sectional view of the interface of the heat generator 22S and the heater support 23 taken along the axial direction of the fuser sleeve 21, a pair of recesses 22*r* may be provided at opposed axial ends of the laminated heat generator 22S outboard of a maximum compatible width W of recording sheet, each of which has a depth corresponding to the thickness of double-sided adhesive tape A in use (e.g., approximately 0.1 mm in the present embodiment) and a certain length extending in the circumferential direction (i.e., the direction in which FIG. is drawn).

During assembly, a piece of double-sided adhesive tape A is disposed within the recess 22*r* at each axial end of the heat generator 22S, followed by placing the recessed surface of the heat generator 22S against the heater support 23 so that the adhesive material retains the heat generator 22S in position on the heater support 23. With the recesses 22*r* provided at the interface between the heat generator 22S and the heater support 23, the adhesive tape T rests flush with the adjoining surface of the heat generator 22S.

Figure 14:
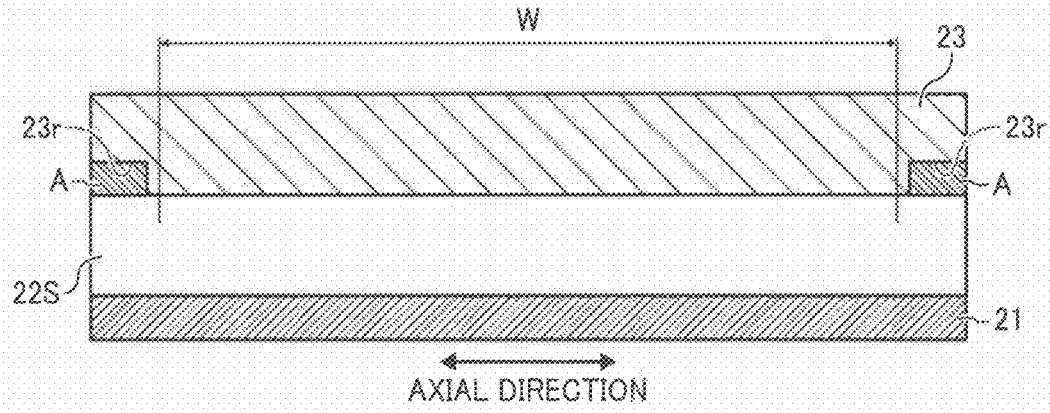
FIG. 14 is a cross-sectional view showing one arrangement of a heater support used with the laminated heat generator, taken along the axial direction of the fuser sleeve.

Alternatively, as shown in FIG. 14, which is another cross-sectional view of the interface of the heat generator 22S and the heater support 23 taken along the axial direction of the fuser sleeve 21, a pair of recesses 23*r* may be provided at opposed axial ends of the heater support 23 outboard of a maximum compatible width W of recording sheet, each of which has a depth in the circumferential direction corresponding to the thickness of double-sided adhesive tape A in use (e.g., approximately 0.1 mm in the present embodiment) and a certain length extending in the circumferential direction (i.e., the direction in which FIG. is drawn).

During assembly, a piece of double-sided adhesive tape A is disposed within the recess 23*r* at each axial end of the heater support 23, followed by placing the heat generator 22S against the recessed surface of the heater support 23 so that the adhesive material retains the heat generator 22S in position on the heater support 23. With the recesses 23*r* provided at the interface between the heat generator 22S and the heater support 23, the adhesive tape T rests flush with the adjoining surface of the heat generator 22S.

In a configuration where the heat generator and the heater support each has a completely flat interfacial surface, disposing adhesive at their interface causes swelling or deformation on the surface of the heat generator facing the fuser sleeve depending on the thickness of adhesive in use. Such irregularities on the surface of the heat generator result in non-uniform contact between the heat generator and the fuser sleeve, leading to reduced thermal efficiency and non-uniform heat distribution in the axial direction of the fuser sleeve.

By contrast, with the arrangements of FIGS. 13 and 14, attaching the heat generator 22S to the heater support 23 may be performed without causing irregularities on the surface of the heat generator 22S facing the fuser sleeve 21. A flat, uniform surface of the heat generator 22S means a uniform contact between the heat generator 22S and the fuser sleeve 21 inboard of the maximum compatible width W of recording sheet, leading to efficient, uniform heating in the axial direction of the fuser sleeve 21.

Thus, the fixing device 20 according to this patent specification incorporates an energy-efficient, high-speed, durable fuser assembly, wherein the combination of the fuser sleeve 21 and the laminated heat generator 22S, each exhibiting a low heat capacity, heats the fixing nip N promptly and efficiently to provide fixing with short warm-up time and first-print time, and wherein the resin-based heat generator 22S exhibits high immunity to wear and tear when repeatedly bent and strained due to vibration or rotation transmitted from the pressure roller 31, leading to stable operation of the fuser assembly over an extended period of time.

The fixing device 20 provides excellent imaging performance with high immunity to variations in contact pressure between the fuser sleeve and the heater, owing to provision of the asymmetric sleeve holder 27 that maintains close, uniform contact between the fuser sleeve 21 and the heater 22 without unduly increasing frictional resistance or torque therebetween. The image forming apparatus incorporating the fixing device benefits from these and other features of the fuser assembly according to this patent specification.

It should be noted that although in the embodiments depicted above, the fixing device 20 employs the laminated resistive heater disposed in contact with the fuser sleeve to directly heat the circumference thereof, alternatively, heating the fuser sleeve may be accomplished by any suitable heating mechanism, such as resistive heater, radiant heater, or electromagnetic induction heater, positioned adjacent to the sleeve holder inside of the loop of the fuser sleeve to indirectly heat the fuser sleeve, that is, to locally heat an adjoining portion of the tubular sleeve holder, which then conducts heat to the entire length of the fuser sleeve rotating around the sleeve holder. In such cases, the sleeve holder 27 is configured as a heat pipe 27A that has no elongated opening or window for exposing the heater to the circumference of the fuser belt.

Figure 15:
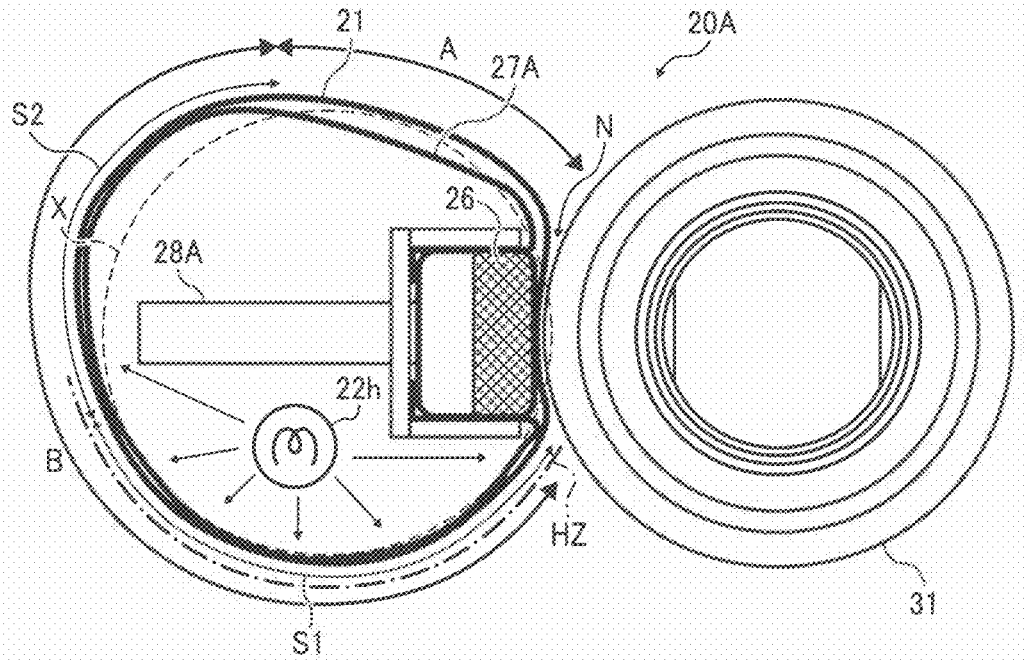
FIG. 15 is an end-on, axial cutaway view schematically illustrating a second embodiment of the fixing device according to this patent specification.

FIG. 15 is an end-on, axial view schematically illustrating one such embodiment of the fixing device 20A according to this patent specification.

As shown in FIG. 15, the overall configuration of the fixing device is similar to that depicted in FIG. 2, wherein the fuser sleeve 21 is paired with the pressure roller 31 pressed against the contact pad 26 via the fuser sleeve 21 to form a fixing nip N, while entrained around the asymmetric sleeve holder or heat pipe 27A accommodating various pieces of fuser equipment in its hollow interior, except that the present embodiment employs a radiant, halogen heater 22*h*, instead of a laminated resistive heater, disposed inside the heat pipe 27A to radiate heat to the heat pipe 27A, as well as an additional, reinforcing member 28A consisting of an elongated beam held against the contact pad 26 to support the pad 26 under pressure, which intercepts radiation from the heater 22*h* to define a particular circumferential portion HZ in which the fuser sleeve 21 is subjected to heating.

As is the case with the first embodiment, the heat pipe 27A comprises a stationary pipe-shaped elongated body extending in its axial direction whose axial cross-section is irregular or asymmetric in shape, that is, does not form a regular, perfect circle of constant curvature.

Specifically, the heat pipe 27A includes a first circumferential section S1 and a second circumferential section S2, the former facing the heated portion HZ of the fuser sleeve 21 and the latter facing upstream from the heated portion HZ of the fuser sleeve 21 in the circumferential direction. The first circumferential section S1 of the heat pipe 27A defines part of an imaginary, substantially perfect cylindrical surface X whose curvature is substantially constant, whereas the second circumferential section S2 extends radially outward from the imaginary cylindrical surface X.

The imaginary cylindrical surface X represents a circular cylinder whose curvature (and hence radius of curvature) is approximately equal to that of the fuser sleeve 21 in its cylindrical configuration, so that the first circumferential section S1 exhibits a radius of curvature approximately equal to the radius of the fuser sleeve 21 in its original, cylindrical configuration.

With continued reference to FIG. 15, the fuser sleeve 21 is shown entrained around the asymmetric heat pipe 27A to rotate in the circumferential direction as the motor-driven pressure roller 31 rotates. According to this patent specification, the irregular or asymmetric configuration of the heat pipe 27A enables the fuser sleeve 21 to stably rotate around the pipe 27A, while establishing close contact with the heat pipe 27A during operation of the fixing device 20A.

Specifically, immediately downstream from the fixing nip N in the circumferential direction (indicated by line A in FIG. 15), the fuser sleeve 21 remains relatively slack and comes slightly apart from the heat pipe 27A as it exits the fixing nip N to proceed toward the second section S2 of the sleeve holder 27. Conversely, upstream from the fixing nip N in the circumferential direction (indicated by line B in the FIG. 15), the fuser sleeve 21 is drawn taut and slides against the heat pipe 27A as it passes along the second section S2 and then the first section 51 of the pipe 27A to enter the fixing nip N.

The fuser sleeve 21 thus tensioned upstream, but not downstream, from the fixing nip N in the circumferential direction can stably rotate without undue torque or load on the rotary driver of the fixing device 20. Moreover, tensioning the fuser sleeve 21 causes the inner circumference of the fuser sleeve 21 to closely contact the heat pipe 27A upstream from the fixing nip N in the circumferential direction.

Note that, with the heat pipe 27A defining the substantially constant curvature S1 to face the heated portion HZ of the fuser sleeve 21 and the irregular curvature S2 protruding radially outward to face upstream of the heated portion HZ, the fuser sleeve 21 can contact and press against the heat pipe 27A along the heated circumferential portion HZ more closely than would be possible with a simple, perfect cylindrical sleeve holder.

Such close contact or pressure established between the fuser sleeve 21 and the heat pipe 27A ensures the heat pipe 27A 22 conducts heat to the fuser sleeve 21 stably and uniformly in the axial and circumferential directions. Consistent heating of the fuser sleeve 21 results in uniform heat distribution across the fixing nip N, which allows for good fixing performance with uniform gloss across a resulting image, as well as a desired, short warm-up time and low energy consumption of the fixing device 20. Further, maintaining the entire surface of the heat pipe 27A in gapless, consistent contact with the fuser sleeve 21 at the heated circumferential portion HZ prevents localized overheating of the heat pipe 27A.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a stationary tubular belt holder extending in an axial direction thereof;

a rotatable, flexible fuser belt looped into a generally cylindrical configuration around the belt holder extending in the axial direction of the belt holder, the tubular belt holder retaining the fuser belt in shape as the belt rotates in a circumferential direction of the belt holder;

a contact member extending in the axial direction of the belt holder, accommodated in the belt holder inside the loop of the fuser belt;

a rotatable pressure member extending in the axial direction, disposed opposite the belt holder with the fuser belt interposed between the contact member and the pressure member to rotate the fuser belt, the pressure member pressing against the contact member through the fuser belt to form a fixing nip through which a recording medium on the fuser belt is conveyed in a conveyance direction under heat and pressure; and a heater disposed adjacent to the belt holder to heat directly or indirectly a predetermined circumferential portion of the fuser belt upstream from the fixing nip in the circumferential direction, the belt holder including:

a first circumferential section having a surface facing the heated portion of the fuser belt, defining part of an imaginary, substantially perfect cylindrical surface whose curvature is substantially constant; and a second circumferential section upstream from the heated portion of the fuser belt in the circumferential direction, which extends radially outward from the imaginary cylindrical surface.

2. The fixing device according to claim 1, wherein the first circumferential section exhibits a radius of curvature approximately equal to a radius of the fuser belt in the generally cylindrical configuration of the fuser belt.

3. The fixing device according to claim 1, wherein the first circumferential section of the belt holder, facing the heated portion of the fuser belt, extends upstream from the fixing nip to a position substantially opposite the fixing nip across a rotational axis of the fuser belt in the circumferential direction.

4. The fixing device according to claim 1, wherein the belt holder exhibits a greater radius of curvature immediately downstream from the fixing nip than a radius of curvature along the first circumferential section thereof in the circumferential direction.

5. The fixing device according to claim 1, wherein the heater comprises a laminated electrical resistance heater.

6. The fixing device according to claim 1, wherein the heater comprises an electromagnetic induction heater that heats the belt holder through electromagnetic induction.

7. The fixing device according to claim 1, wherein the heater comprises a radiant heater.

8. An image forming apparatus comprising:

an electrophotographic imaging unit to form a toner image on a recording medium; and a fixing device to fix the toner image in place on the recording medium, the fixing device including:

a stationary tubular belt holder extending in an axial direction thereof;

a rotatable, flexible fuser belt looped into a generally cylindrical configuration around the belt holder extending in the axial direction of the belt holder, the tubular belt holder retaining the fuser belt in shape as the belt rotates in a circumferential direction of the belt holder;

a contact member extending in the axial direction of the belt holder, accommodated in the belt holder inside the loop of the fuser belt;

a rotatable pressure member extending in the axial direction, disposed opposite the belt holder with the fuser belt interposed between the contact member and the pressure member to rotate the fuser belt, the pressure member pressing against the contact member through the fuser belt to form a fixing nip through which the recording medium on the fuser belt is conveyed in a conveyance direction under heat and pressure; and a heater disposed adjacent to the belt holder to heat directly or indirectly a predetermined circumferential portion of the fuser belt upstream from the fixing nip in the circumferential direction, the belt holder including:

a first circumferential section having a surface facing the heated portion of the fuser belt, which defines part of an imaginary, substantially perfect cylindrical surface whose curvature is substantially constant; and a second circumferential section upstream from the heated portion of the fuser belt in the circumferential direction, which extends radially outward from the imaginary cylindrical surface.

9. The fixing device according to claim 1, wherein the first circumferential section has a first radius of curvature that is substantially constant, wherein the second circumferential section includes a second radius of curvature, and wherein the first radius of curvature is different from the second radius of curvature.

10. The image forming apparatus according to claim 8, wherein the first circumferential section has a first radius of curvature that is substantially constant, wherein the second circumferential section includes a second radius of curvature, and wherein the first radius of curvature is different from the second radius of curvature.

* * * * *